US005156585A

United States Patent [19]

Dimur et al.

[11] Patent Number: 5,156,585

[45] Date of Patent: Oct. 20, 1992

[54] APPARATUS FOR OPENING ENVELOPES

[75] Inventors: Gérard Dimur, Savigny sur Orge; Jean-Claude Haroutel, Orsay, both of France

[73] Assignee: Alcatel Satmam, Bagneux, France

[21] Appl. No.: 786,842

[22] Filed: Nov. 1, 1991

[30] Foreign Application Priority Data

Nov. 16, 1990 [FR] France ..... 90 14297

[51] Int. Cl.[5] ..... B65B 43/26; B65B 43/39

[52] U.S. Cl. ..... 493/409; 493/465; 53/381.7

[58] Field of Search ..... 493/309, 409, 465, 923; 53/381.5, 381.7

[56] References Cited

U.S. PATENT DOCUMENTS 3,935,800 2/1976 Sette et al. ..... 493/465

3,974,749 8/1976 Luperti et al. ..... 493/465

*Primary Examiner*—William E. Terrell

*Attorney, Agent, or Firm*—Sughrue, Mion, Zinn, Macpeak & Seas

[57] ABSTRACT

First and second drive rollers and a slideway feed in an envelope to be opened. A third drive roller drives the body of the envelope in a direction parallel to the fold connecting the flap to the body of the envelope, the drive roller rolling over the face opposite from the face against which the flap of the envelopes folded down, without rolling over the region close to the fold. A counter roller situated facing the drive roller, rolls over the face against which the flap is folded down, without rolling over the flap. An idler wheel situated facing the drive roller has a rim which rolls over the flap close to the fold connecting the flap to the body of the envelope, and which penetrates into the cylindrical volume defined by the straight generator lines of the third drive roller, so as to arch the body about an axis approximately parallel to the fold. A freely rotatable cone moves the flap and the body apart by being inserted into the space created by the arching. Guides remove an envelope while keeping it open.

8 Claims, 4 Drawing Sheets

APPARATUS FOR OPENING ENVELOPES

The invention relates to apparatus for opening mailing envelopes each composed of a body and a flap interconnected by a fold, the flap being folded down against the body prior to the envelope being opened. This type of apparatus is generally incorporated in a mail handling machine which fills, closes, and then franks envelopes. The apparatus must open envelopes at a high rate so as to match the rate of filling. Operation of the apparatus must be reliable, even in the presence of envelopes having small faults such as accidental points of adhesion between the flap and the body of an envelope, so as to avoid jamming which requires the machine to be stopped and an operator to intervene.

BACKGROUND OF THE INVENTION

French Patent Application No. 2,598,975 describes apparatus for opening envelopes and including:

a conveyor for feeding the envelopes along a horizontal slideway, the fold of each envelope sliding along this slideway;

rollers for extracting an envelope from the slideway along a vertical path;

a fixed blade, parallel to the axes of the rollers, and co-operating with the rollers to arch the body of an envelope without arching the flap, so as to create a space between the body and the flap, the blade then being inserted into the space and pivoting the flap through 180° by means of the envelope moving in translation relative to the blade; and means for carrying an envelope away while keeping it open, after it leaves the rollers.

That apparatus has several drawbacks. The motion of each envelope is discontinuous since the envelope arrives horizontally and leaves vertically. The operation of the rollers is also discontinuous. One of them is mounted on a pivoting arm having a rest position in which the rollers are spaced apart to enable an envelope to arrive, and a work position in which the rollers are clamped together and turn so as to drive the envelope. These discontinuities of motion limit the rate of operation of that apparatus.

When separating the flap from the body of the envelope and pivoting the flap through 180°, the blade acts very suddenly because it comes up against the inside of the fold connecting the flap to the body of the envelope, before the flap starts to pivot.

Furthermore, that known apparatus is sensitive to the presence of accidental points of adhesion between the flap and the body of an envelope. At the moment when the blade is inserted between the flap and the body of the envelope, there is a risk that the flap will tear, thereby jamming the apparatus.

That apparatus has to be adjusted for each type of envelope, because the position of the envelope relative to the blade must be such that the blade is inserted properly under the flap, and such that the rollers pinch the envelope without pinching the flap. If the envelope is smaller, the two rollers might not be able to extract it from the slideway. If the envelope is larger, the end of the flap might extend beyond the end of the blade. In this case, the blade cannot be inserted between the flap and the body of the envelope. The position of the end of the blade must also be adjusted as a function of the thicknesses of the envelopes to be opened. In order for that prior apparatus to operate correctly, accurate adjustment is therefore necessary, as a function of the sizes of the envelopes and of their flaps.

The fact that open envelopes leave that apparatus in a direction perpendicular to the arrival direction of envelopes to be opened complicates integrating the apparatus into a mail handling machine, because it cannot be integrated into a conventional conveying station in which the envelopes follow a constant direction.

An object of the invention is to provide apparatus which does not suffer from the drawbacks of that known apparatus.

SUMMARY OF THE INVENTION

The invention provides apparatus for opening envelopes each composed of a body and a flap interconnected by a fold, the flap being folded down against the body prior to the envelope being opened;

said apparatus including:

means for feeding in envelops to be opened;

arching means for arching the body of an envelope without arching the flap, so as to create a space between the body and the flap;

separating means for separating the flap from the body by said separating means being inserted into the space; and means for removing an envelope while keeping it open;

wherein the separating means for separating the flap from the body include a cone which is free to rotate about its axis of symmetry, the cone rolling over the face of the body of the envelope against which the flap is folded down, and being in contact with the body of the envelope along one of the generator lines of the cone; and wherein the vertex of the cone is rounded and points towards the fold.

Apparatus having this feature is particularly unlikely to jam because the point of contact where the edge of the flap meets the cone is displaced both over the cone and also along the edge of the flap as the envelope is driven through the apparatus. The point of contact is displaced towards the base of the cone and towards the tip of the flap. As the point of contact is displaced, the flap is moved away from the body by the cone. Operating takes place smoothly.

Furthermore, since the cone is in contact with the body of the envelope along one of its generator lines, and since the cone is free to rotate, it rolls over this surface because the envelope is displaced by the action of the drive roller. This rolling motion reduces the resistance met by the body of the envelope on coming into contact with the cone. Moreover, the rotation of the cone facilitates insertion of the cone into the space between the body and the flap, because this rotation increases the relative speed of the surface of the cone with respect to the flap, over the points of contact between the cone and the flap. This increase in relative speed reduces the sliding friction of the cone against the surface of the flap, and facilitates breaking through any accidental points of adhesion, thereby considerably reducing the risks of jamming.

The axis of rotation of the cone may slope relative to a plane orthogonal to the plane of the envelope as fed into the apparatus, so that the cone is inserted into the space created between the flap and the body, with the base of the cone leaning further outwards than the vertex thereof.

Apparatus having this feature enables the risks of jamming to be reduced still further. The radius of curvature of the cone at its point of contact with the flap is increased by the slope of the cone. Furthermore, in the event of resistance due to accidental points of adhesion, the displacement of the cone relative to the envelope creates forces directed towards the fold and does not create forces directed away from the fold. Therefore, the displacement creates forces tending to open the flap but not tending to tear the flap at the fold.

The separating means may further include a moving support equipped with a spring for supporting the cone and applying a force to it that is directed towards the drive roller, so that, during the time interval between opening two envelopes, the cone is brought into contact with the drive roller and rotated by friction against the roller. The drive roller includes a length made of a material resistant to wear, which length is disposed in the region of the drive roller that makes contact with the cone.

Apparatus having this feature rotates the cone during the time interval between opening two envelopes, thereby ensuring the cone is already rotating when it comes into contact with the body and the flap of an envelope. The cone thus rotates faster than it would if it were rotated solely by friction against the body of the envelope. Increasing the speed of the cone relative to the flap reduces the friction force at the points of contact between the cone and the flap, and consequently further reduces the risk of jamming.

BRIEF DESCRIPTION OF THE DRAWINGS

An embodiment of the invention is described by way of example with reference to the accompanying drawings, in which.

DETAILED DESCRIPTION

Figure 1:
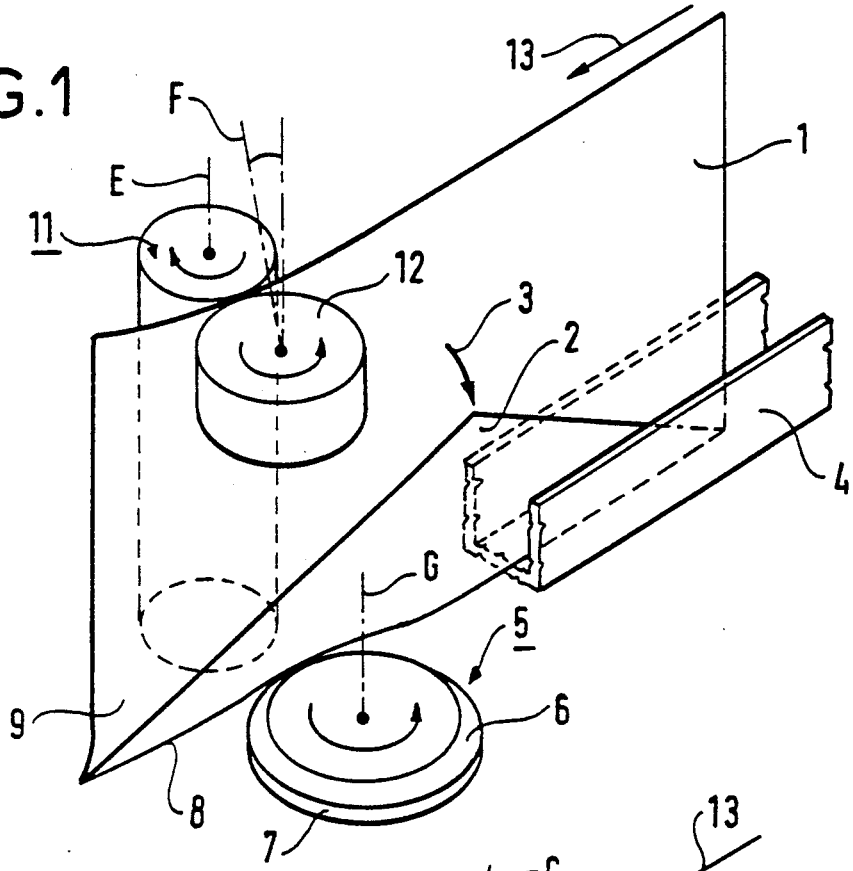
FIGS. 1 and 2 show how the embodiment operates, while omitting to show certain parts for reasons of clarity.

FIG. 1 shows the arrival of an envelope to be opened, and a first opening step consisting in arching the body 1 of the envelope without arching the flap 2, thereby creating a space 9 between the body 1 and the flap 2. The envelope is fed into the apparatus along a direction shown by arrow 13 by means of a conveyor (not shown) including a channel-section slideway 4. The envelope slides along the slideway 4 on the fold 8 connecting the flap 2 to the body 1.

The body 1 is inserted between a drive roller 11 and a counter-roller 12. The drive roller 11 is rotated by a motor (not shown) about an axis of rotation E that is parallel to the plane of the body 1 and orthogonal to the fold 8. The drive roller 11 rolls over the face of the envelope against which the flap is not folded down 2. The counter-roller 12 rolls over the face of the envelope against which the flap 2 is folded down, without rolling over the flap. The length of the drive roller 11 is such that it rolls over most of the surface of the envelope, but not over the region close to the fold 8. The counter-roller 12 is situated close to that end of the roller 11 which is distant from the region of the fold 8. An idler wheel 5 is situated facing the drive roller 11, near to that end thereof which is close to the fold 8, but the roller is not long enough to touch the wheel 5. The wheel 5 has a rim 6, 7 which rolls over the flap 2, the rim rolling parallel to the fold 8 and close thereto.

In this embodiment, the axis of rotation G of the wheel 5 is parallel to the axis of rotation E of the drive roller 11. The diameter of the wheel 5 is such that the rim 6, 7 penetrates into the cylindrical volume defined by the straight generator lines of the drive roller 11, so that an envelope passing between the drive roller 11 and the wheel 5 is not pinched therebetween but is arched by the end of the roller 11 and by the wheel 5 about an axis which is approximately parallel to the fold 8. The body 1 undergoes arching because it is held by the counter-roller 12. Since the flap 2 is not held by the counter-roller 12, it remains approximately plane, and consequently a space 9 is created between the body and the flap 2. The flap 2 thus starts to open in the direction of arrow 3. Since the envelope is driven by the roller 11, the envelope rotates the wheel 5 which therefore offers minimal resistance while the envelope is staring to open.

The counter-roller 12 is free to rotate about an axis F which slopes slightly relative to the axis E of the roller 11, in the displacement direction of the envelope, so that the counter-roller 12 exerts a force on the body 1 urging it towards an idler wheel (5). The rim of the wheel 5 comprises two portions: a truncated cone portion 6 and a cylindrical portion 7. The truncated cone portion 6 is the portion closer to the roller 11. If an envelope moves away from the bottom of the slideway 4 and rises up onto the truncated cone portion 6 of the wheel 5 instead of remaining in contact with the cylindrical portion 7 of its rim, then the shape of the rim of the wheel 5 enables the envelope to be put back into place by the action of the force exerted by the counter-roller 12 towards the wheel 5.

Figure 2:
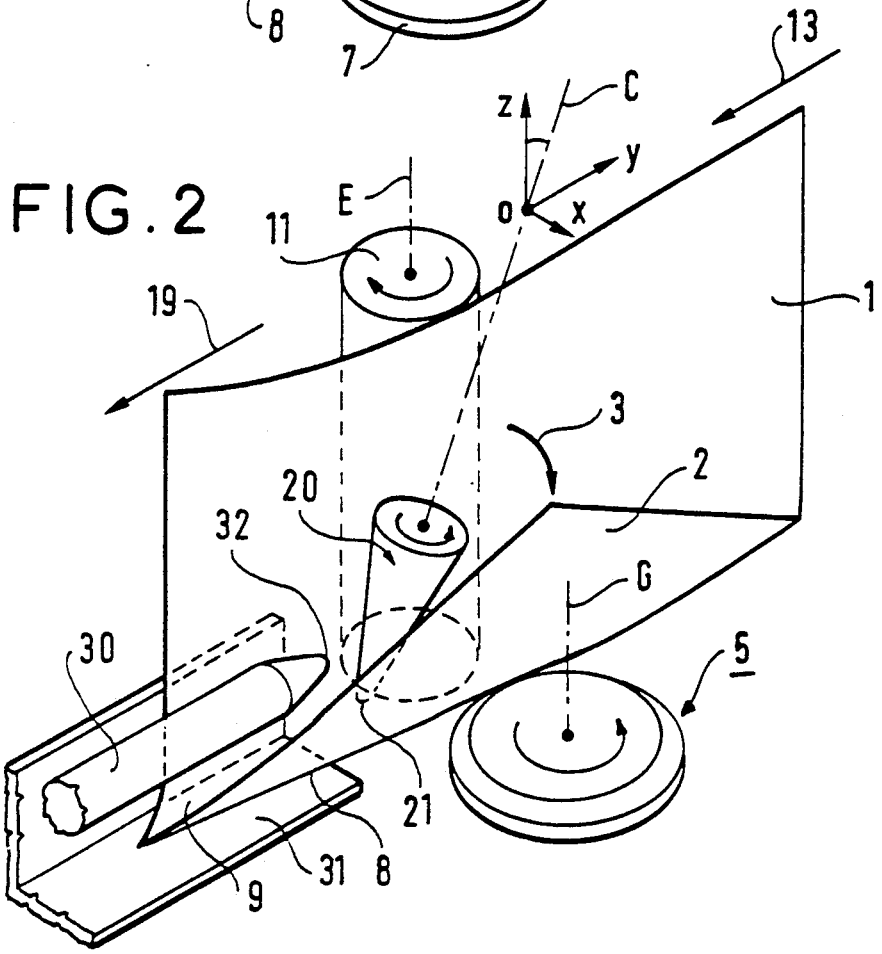

FIG. 2 shows a second step in the operation of the same embodiment, while not showing all of the parts thereof, for reasons of clarity. The counter-roller 12 and the slideway 4 are not shown. In contrast, FIG. 2 shows: a cone 20 designed to complete envelope opening, a first guide 31 in the form of an angle bar, and a second guide 30 in the form of a pin, the two guides being designed to guide an envelope leaving the apparatus, while keeping the envelope open at right angles.

The section through the cone 20 on a plane containing its axis of symmetry C is a triangle having an angle of about 30° at the vertex of the cone. The vertex 21 of the cone 20 is rounded and points towards the fold 8. The cone 20 is free to rotate about its axis of symmetry C. The cone is situated facing the drive roller 11 and rolls over that face of the body 1 of the envelope against which the flap 2 is folded down. The cone makes contact with the body 1 along one of the generator lines of the cone. Friction between the body 1 and the cone 20 rotates the cone. As is apparent below, during the time interval between opening two successive envelopes, the cone 20 is also rotated, and in the same direction, by friction against the drive roller 11.

The cone 20 penetrates into the space 9 created during the first operating step between the flap 2 and the body 1 by arching the body 1. The cone 20 pushes the flap 2 away by pivoting it about the fold 8, in the direction of arrow 3. The opening movement is very gradual because the point of contact where the cone 20 meets the edge of the flap 2 is displaced along this edge. The flap 2 is always triangular or trapezium shaped, and consequently the edge of the flap 2 has a linear shape sloping relative to the fold 8. Due to the slope of this shape, the point of contact is displaced on the surface of the cone 20 towards the base thereof, as the point of contact moves towards the vertex of the flap. Since the diameter of the cone 20 increases towards its base, the cone 20 moves the flap 2 smoothly further away from the body 1 without any jerks.

The axis of symmetry and of rotation C makes an angle of about 17° relative to a plane oxz orthogonal to the plane of the envelope when it is fed into the apparatus, so that the cone 20 is inserted into the space 9 with its base leaning further outwards than its vertex 21, relative to the space 9. In this way, the radius of curvature of the cone 20 at the point of contact with the flap 2 is greater, thereby reducing the pressure on the points of contact and thus reducing the risk of tearing. The frictional force of the cone 20 against the flap 2 urges the flap towards the wheel 5, whereas if the slope of the cone 20 were inverted, i.e. if the cone 20 were inserted into the space 9 with its vertex leaning outwards, the friction of the cone 20 against the flap 2 would urge the flap 2 away from the wheel 5, thereby pulling on the fold 8, and could therefore cause the flap 2 to tear in the event that the flap resists opening because of accidental points of adhesion.

The axis C of symmetry and of rotation of the cone 20 slopes at about 17° relative to a plane oyz which coincides with the plane of the envelope when it is fed into the apparatus. This slope enables the cone 20 to be made tangential to the body 1 of the envelope along one of the generator lines of the cone 20, so as to press the cone 20 against the body 1 to the maximum possible extent. This maximizes the chances of the cone being inserted into the space 9 created by arching.

The ends of guides 31 and 30 are close to the cone 20, so that the guides take over from the cone in keeping the envelope open. Guide 31 is formed by two walls constituting an angle bar, so that its concave portion matches the convex portion of a right angle formed by the body 1 and the flap 2 of the open envelope. Guide 30 is in the form of pin constituted by a cylindrical rod ending in a rounded conical tip 32, so that it penetrates into the space 9 after the cone 20 and retains the degree of opening obtained by the cone 20. This degree of opening is close to 90° relative to the body 1.

The body 1 of the envelope slides between a wall of guide 31 and guide 30, while the fold 2 slides between the other wall of guide 31 and guide 30.

Guide 31 and guide 30 guide the envelope in translation, while keeping it open, along a direction which is shown by arrow 19 and which is orthogonal to the axis of rotation 1 of the drive roller 11. In a preferred embodiment, this direction is in alignment with the guide direction of the slideway 4 at the entrance of the apparatus, which guide direction is shown by arrow 13.

Figure 3:
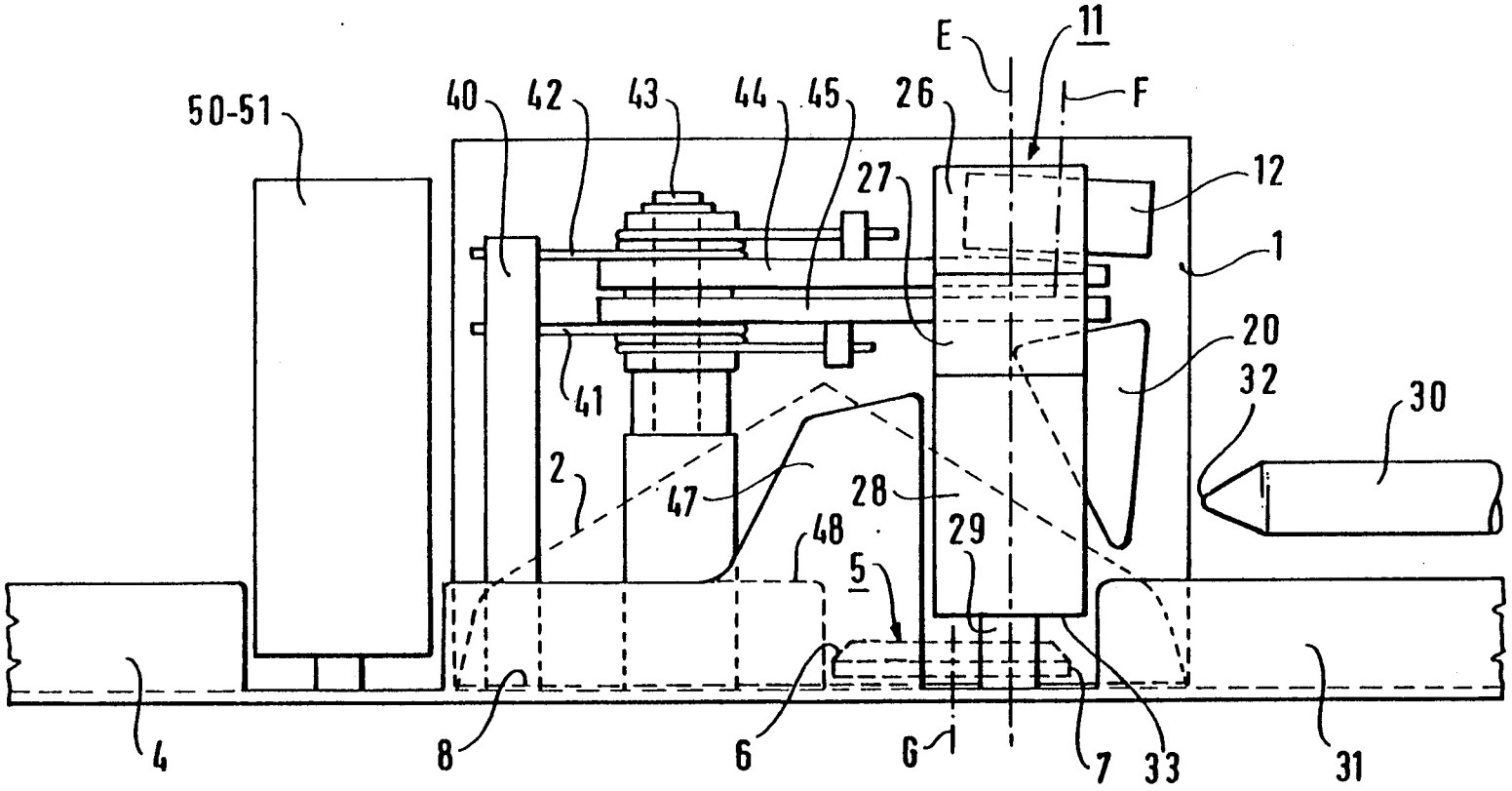
FIG. 3 is an elevation view of the embodiment showing all the parts thereof.

FIG. 3 is a more detailed elevation view of this embodiment, showing all the parts and an envelope which is about to be opened. The envelope is fed along the slideway 4 in translation in the direction shown by arrow 13 by means of two drive rollers 50 and 51 actuated by a motor which is not shown. This figure shows that the sidewall of the slideway 4 that is near the drive roller 11 has an enlarged portion close to the roller 11 so as to constitute a deflector 47. This deflector 47 guides the face of the envelope against which the flap is not folded down 2 so that this face is tangential to the surface of the roller 11. At the same end of the slideway 4, the other sidewall ends in a straight edge 48 cut off a short distance before the roller 11 so as not to obstruct opening the flap 2 of an envelope.

The drive roller 11 is composed of three superposed portions each having the same diameter: a portion 26 made of rubber, because it is situated facing the counter-roller 12 and must adhere to each envelope so as to drive it; a portion 27 made of a material resistant to wear, and situated facing the base of the cone 20, which base rubs against portion 27 during the time interval between opening two envelopes; and a portion 28 made of aluminum treated so as to be hard on the surface, which portion 28 acts merely as an envelope guide.

The end of the drive roller 11 that is near the idler wheel 5 has a plane face 33 fixed to a drive shaft 29. This plane face 33 is situated at a certain distance from the nearer of the two plane faces of the wheel 5, thereby enabling the body 1 and the flap of the envelope to pass between the wheel 5 and the roller 11 without the body or the flap being pinched, but with the body 2 nevertheless being arched.

The counter-roller 12 is supported by an arm 44 pivoting about a fixed shaft 43 which is a cylinder having its axis of symmetry parallel to the axis E of the roller 11. Arm 44 urges the counter-roller 12 towards portion 26 of the roller 11, under the action of a hairpin spring 42 having one of its ends bearing against a lug on arm 44, and its other end bearing against a fixed arm 40. The cone 20 is supported by an arm 45 also pivoting about the fixed shaft 43. Arm 45 urges the cone 20 towards portion 27 of the drive roller 11, under the action of a hairpin spring 41 having one of its ends bearing against a lug on arm 45, and its other end bearing against the fixed arm 40. Arms 44 and 45 and their associated springs 41 and 42 are positioned high enough to avoid obstructing the tip of the flap 2 as it goes past during envelope opening.

FIG. 3 also shows the approximately 17° slope of the axis C of the cone 20 relative to a plane orthogonal to the plane of the envelope as fed into the apparatus.

Figure 4:
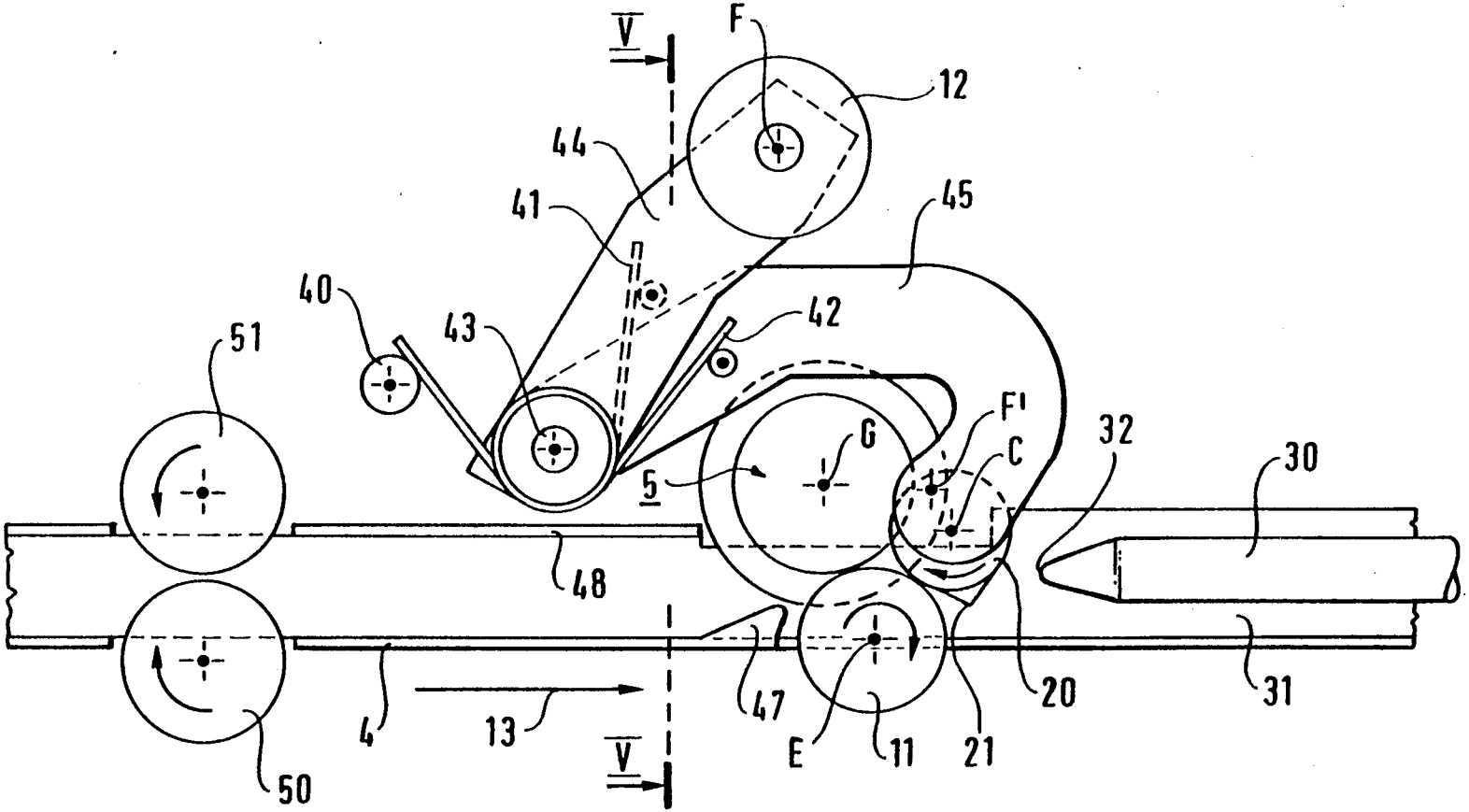
FIG. 4 is a plan view of the embodiment showing all the parts thereof, but with one of these parts being moved away so as to enable the other parts to be seen more clearly.

FIG. 4 is a plan view of this embodiment, showing all the parts thereof but with no envelope. Arm 44 is shown swung away so that the counter-roller 12 does not obstruct the view of the cone 20 and of the wheel 5. The drive rollers 50 and 51 are disposed symmetrically relative to the slideway 4 situated at the entrance to the apparatus. Guides 30 and 31 are situated in alignment with the slideway 4.

FIG. 4 shows the relative layout of the respective axes C, E, and G of the cone, of the drive roller 11, and of the idler wheel 5. The axis C of the cone 20 and the axis G of the wheel 5 are situated on respective sides of a plane which is perpendicular to the plane of an envelope fed into the apparatus, and which contains the axis E of the drive roller 11. During normal operation of the apparatus, the arm 44 carrying the counter-roller 12 is pressed against the roller 11 by the spring 41. The axis F of the counter-roller 12 then occupies a position which is shown by the point F' in FIG. 4 and which is situated in the plane of arm 44. Point F' is situated close to the axis C of the cone 20, i.e. on the same side as axis C relative to a plane which is orthogonal to the plane of the envelope and which contains axis E. This layout of both the axis of rotation G of the idler wheel 5 and also the axis of formation E of the drive roller 11 causes the body of the envelope to be arched slightly about axis E. This arching facilitates creating the space 9 (shown in the preceding figures) between the flap 2 and the body 1 of an envelope.

Figure 5:
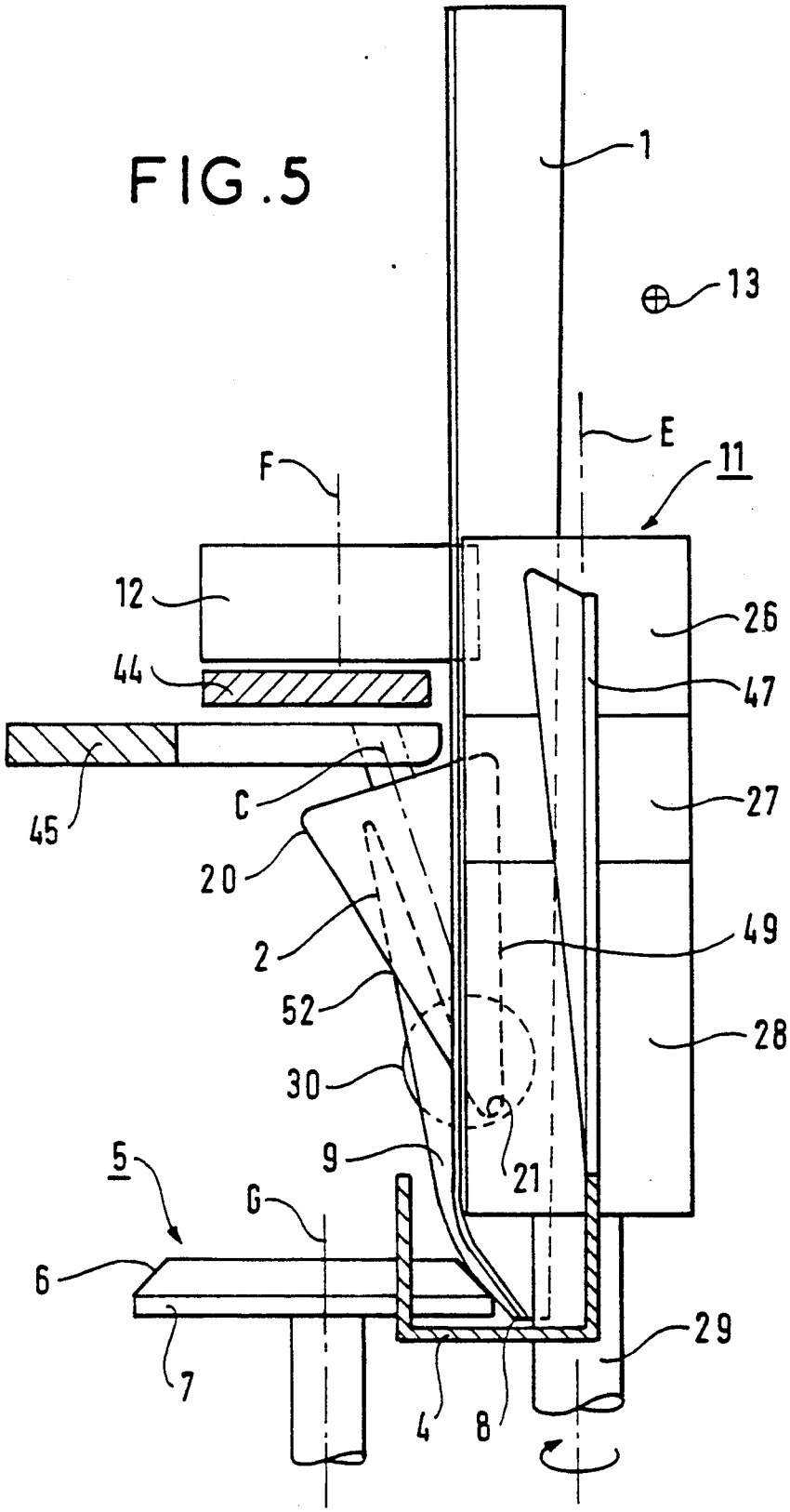
FIG. 5 is an end view showing a section through the embodiment.

FIG. 5 is a more detailed end view showing a section through this embodiment along the line VV. The envelope 1, 2 is shown at the moment when the cone 20 penetrates into the space 9 created between the body 1 and the flap 2 by the arching performed by the idler wheel 5 in co-operation with the drive roller 11. The envelope 1, 2 is driven along the direction indicated by arrow 13, i.e. moving away from the observer. FIG. 5 further shoes the arching performed by the counter-roller 12, the drive roller 11 and the wheel 5, which arching may be seen in particular at the top of the figure: a portion of the body 1 is not perpendicular to the plane of the figure because it is arched about the axis E of the roller 11.

In this embodiment, the flap is triangular in shape. The edge of the flap 2 is in contact with the cone 20 at a point of contact 52. The point 52 is displaced both over the cone 20 and along the edge of the flap 2 as the envelope is driven through the apparatus. The point 52 is displaced both towards the tip of the flap 2 and towards the base of the cone 20. As the point 52 is displaced, the flap 2 is separated from the body 1 by the cone 20 without any jerky movements. Consequently, the risk of the envelope tearing is very small.

FIG. 5 also shows that the region on the cone 20 that is situated close to the drive roller 11 has a generator line 49 which is tangential to the surface of the body 1. The cone 20 therefore hugs the surface of the body 1 and has every likelihood of penetrating into the space 9 between the flap 2 and the body 1. These figures show the 17° slope of the axis of rotation C of the cone 20 relative to the plane of the envelope as inserted into the apparatus.

The scope of the invention is not limited to the embodiments shown and described above. Numerous variants on these embodiments can be implemented by a person skilled in the art. In particular, it is possible to use other means for feeding in envelopes to be opened, and other means for removing an envelope while keeping it open. It is possible to change the disposition of the axis of rotation of the cone, and to change the disposition of the axis of rotation of the idler wheel.

We claim:

1. Apparatus for opening envelopes each composed of a body and a flap interconnected by a fold, the flap being folded down against the body prior to the envelope being opened;

said apparatus including:

means for feeding in envelopes to be opened;

driving and arching means for driving and arching the body of an envelope without arching the flap, so as to create a space between the body and the flap;

separating means for separating the flap from the body by said separating means being inserted into the space; and means for removing the envelope while keeping the flap separated;

wherein the separating means for separating the flap from the body include a cone which is free to rotate about its axis of symmetry, the cone rolling over the face of the body of the envelope against which the flap is folded down, and being in contact with the body of the envelope along one of the generator lines of the cone; and wherein the vertex of the cone is rounded and points towards the fold.

2. Apparatus according to claim 1, wherein the axis of rotation of the cone slopes relative to a plane orthogonal to the plane of the envelope as fed into the apparatus, so that the cone is inserted into the space created between the body and the flap, with the base of the cone leaning further outwards than the vertex thereof.

3. Apparatus according to claim 2, wherein the driving and arching means include a drive roller which drives the body of the envelope in a direction parallel to the fold connecting the flap to the body, the drive roller rolling over the face opposite from the face against which the flap is folded down, without rolling over the region close to the fold;

wherein the separating means further include a moving support equipped with a spring for supporting the cone while applying a force to it that is directed towards the drive roller, so that, during the time interval between opening two envelopes, the cone is brought into contact with the drive roller and rotated by friction against the roller; and wherein the drive roller includes a length made of a material resistant to wear, which length is disposed in the region of the drive roller that makes contact with the cone.

4. Apparatus according to claim 3, wherein the driving and arching means further include:

a counter-roller situated facing the drive roller and cooperating therewith, and rolling over the face against which the flap is folded down, without rolling over the flap; and an idler wheel situated facing the drive roller and having a rim which rolls over the flap close to the fold connecting the flap to the body of the envelope, and which penetrates into the cylindrical volume defined by the straight generator lines of the drive roller, so as to arch the body about an axis approximately parallel to the fold;

wherein the counter-roller has an axis of rotation which makes a non-zero angle relative to the axis of rotation of the drive roller, so as to exert a force on the body urging it towards the idler wheel; and wherein the rim of the idler wheel comprises a cylindrical portion and a truncated cone portion which is the portion nearer to the drive roller.

5. Apparatus according to claim 1, wherein the means for feeding in an envelope to be opened and the means for removing an envelope while keeping it open each include means for guiding the envelope in translation along the same direction orthogonal to the axis of rotation of the drive roller.

6. Apparatus according to claim 3, wherein the means for removing an envelope while keeping it open include:

a first guide in the form of an angle bar, having its concave portion in contact with the fold interconnecting the body and the flap of the open envelope;

a second guide in the form of a pin, having its long axis parallel to the axis of the first guide, and having a rounded end situated close to the cone so as to be inserted between the body and the flap after the cone; and wherein the guide direction of the first and second guides is orthogonal to the axis of rotation of the drive roller.

7. Apparatus according to claim 3, wherein the means for feeding in envelopes to be opened include a guide in the form of a slideway, having its long axis perpendicular to the axis of rotation of the drive roller; and two other drive rollers having their axes of rotation parallel to the axis of rotation of said drive roller.

8. Apparatus according to claim 4, wherein the axis of rotation of the counter-roller and the axis of rotation of the idler wheel are situated on respective sides of a plane which contains the axis of rotation of the drive roller and which is orthogonal to the plane of the body of the envelope as fed into the apparatus, so that the body is further arched about the axis of rotation of the drive roller.

* * * * *